US005566764A

United States Patent [19]

Elliston

[11] Patent Number: 5,566,764

[45] Date of Patent: Oct. 22, 1996

[54] IMPROVED COIL TUBING INJECTOR UNIT

[76] Inventor: Tom Elliston, 1401 Westover La., Fort Worth, Tex. 76107

[21] Appl. No.: 458,228

[22] Filed: Jun. 16, 1995

[51] Int. Cl.[6] ..... E21B 19/22

[52] U.S. Cl. ..... 166/385; 166/77.3; 166/85.5; 226/173; 226/196

[58] Field of Search ..... 166/385, 77.3, 166/77.2, 85.5; 226/173, 172, 171, 196, 199

[56] References Cited

U.S. PATENT DOCUMENTS

| | | | |
|---|---|---|---|
| 1,288,866 | 12/1918 | Friel | 226/173 |
| 3,128,930 | 4/1964 | Lehnert | 226/173 |
| 3,700,158 | 10/1972 | Schatz et al. | 226/173 |
| 5,133,405 | 7/1992 | Elliston | 166/77 |
| 5,309,990 | 5/1994 | Lance | 166/77.3 |
| 5,346,112 | 9/1994 | Ziemek et al. | 226/173 |

*Primary Examiner*—Hoang C. Dang
*Attorney, Agent, or Firm*—Charles D. Gunter, Jr.

[57] ABSTRACT

A coil tubing injector unit is shown for injecting tubing into a well bore. A main injector frame is positioned adjacent the well bore and includes a longitudinal opening which defines a vertical run for the injector unit which is alignable with the well bore vertical axis. Gripper block assemblies are carried on the main injector frame and include plier-like halves which are pivotable between an open position and a closed, gripping position as the assemblies enter the vertical run so that the plier halves grip a selected length of tubing fed into the main injector frame along the central vertical axis of the injector unit to inject the tubing into the well bore. The profile of the vertical run is designed to minimize loading on the gripper block assemblies. The section modulus of the material used to manufacture the vertical run is also designed to allow a controlled flex of the run in order to soften the gripper loading as the gripper block assemblies enter the vertical run.

11 Claims, 7 Drawing Sheets

IMPROVED COIL TUBING INJECTOR UNIT

BACKGROUND OF THE INVENTION

1. Field of the Invention

The present invention relates generally to devices for operating on wells, such as in workover operations. More specifically, the present invention relates to coiled tubing systems for injecting and extracting continuous lengths of tubing into and out of wells in various well servicing operations.

2. Description of the Prior Art

Various tubing systems are shown in the prior art for working on wells. Generally speaking, a continuous metal tubing is driven down the well bore by means of an injector head. In the prior art devices, a pair of continuous-chain tube gripping assemblies were motor driven in the injector head to grip the tubing and move it down the well bore. Reverse operation of the gripping assemblies was used to withdraw the tubing string from the well bore. At the surface, the tubing was stored on a large drum or reel from which the tubing was withdrawn by the pull of the injector head. The reel was motor driven to rewind the tubing as it was withdrawn from the well.

The prior art coiled tubing systems utilized opposing chain designs in which a plurality of gripper members were carried by the opposing chains, the grippers being frictionally driven to engage a selected length of tubing for injecting the tubing within the well bore.

The prior art designs suffered from a number of disadvantages. The opposing chain drive design could not be easily removed from the selected length of tubing being inserted within the well bore if problems occurred during the well working operation. As a result, it was usually necessary to cut the tubing at the well surface with the result being a weakened section of the tubing string. The opposing chain drive designs satisfactorily gripped smaller diameter tubing such as one inch tubing but were not well adapted for gripping larger diameter tubing. The prior art systems also required a large number of working parts which increased maintenance and operating costs. Because the opposing grippers were formed with jaw openings of fixed diameter, it was not easy to retrofit the injector head for a different size diameter of coil tubing in the field. It was also difficult to prevent wear to high dollar component parts of the prior art devices such as the fixed diameter grippers.

In Applicant's prior U.S. Pat. No. 5,133,405, issued Jul. 28, 1992, entitled "Coil Tubing Injector Unit", many of the aforementioned shortcomings were overcome. The '405 patent shows a coil tubing injector which is positioned adjacent the well bore and includes a longitudinal opening which defines a vertical run for the injector unit which is alignable with the well bore vertical axis. Gripper block assemblies are carried on the main injector frame and include plier-like halves which are pivotable between an open position and a closed, gripping position as the assemblies enter the vertical run so that the plier halves grip a selected length of tubing fed into the main injector frame along the central vertical axis of the injector unit to inject tubing into the well bore. A drive mechanism, including a chain drive, is located on the main injector frame and drives the gripper block assemblies in a continuous loop within the main injector frame.

The coil tubing injector shown in the '405 patent was able to accommodate larger diameter tubing and could be readily refitted in the field to accommodate a variety of tubing sizes.

The novel injector also featured fewer moving parts and lower maintenance costs as compared to the prior art units. The new injector also featured an open face design to allow the unit to be easily removed from a string of tubing being injected into a well.

In spite of these advances, certain improvements have been made in the new injector design which allow it to operate more smoothly and quietly with less wear and tear on the gripper block assemblies and the vertical run of the main injector frame. These improvements also allow the gripper block assemblies to more firmly and securely engage the coil tubing being injected into the well bore and can more easily accommodate tubing sizing and dimensional variations. The improved design allows the gripper block assemblies to go from the unloaded to fully loaded positions within the injector frame vertical run with minimum ease.

SUMMARY OF THE INVENTION

The coil tubing unit of the invention is used to inject tubing into a well bore having a vertical well axis. The coil tubing injector unit includes a main injector frame which is positionable adjacent the well bore. The main injector frame has a top, a bottom and opposing vertical sides, a selected one of the opposing vertical sides having a longitudinal opening formed therein which defines a vertical run for the injector unit. The vertical run defines a central vertical axis for the injector unit which is alignable with the well bore vertical axis. A plurality of gripper block assemblies are carried on the main injector frame, each of the gripper block assemblies including a pair of plier-like halves which are pivotable between an open position and a closed, gripping position as the assemblies enter the vertical run, whereby the plier halves grip a selected length of tubing fed into the main injector frame along the central vertical axis of the injector unit in order to inject the tubing into the well bore. Drive means located on the main injector frame drive the gripper block assemblies within the main injector frame.

The vertical run of the main injector frame is defined by opposing vertical rails which are spaced apart a selected distance for frictionally engaging the gripper block assemblies as the assemblies enter the vertical run, each opposing vertical rail having an upper tapered surface which is shaped as a linear accelerator ramp in order to minimize loading on the gripper block assemblies as they enter the vertical run and reduce noise during operation of the injector unit. Each of the upper tapered surfaces has an outermost extent which is concave in profile, the outermost extent of each upper tapered surface being joined to an innermost extent which assumes a convex profile. The innermost extent of each upper tapered surface join a vertical planar surface which extends downwardly in the direction of the well bore vertical axis. Each opposing vertical rail also has a lower tapered surface which serves as an oppositely arranged linear accelerator ramp in order to allow the gripper block assemblies to smoothly move apart as they leave the vertical run.

Each opposing vertical rail preferably has a section modulus which is designed for a predetermined working stress as the gripping blocks enter the vertical run and contact the vertical rails, the predetermined working stress being selected to allow a selected deflection of the vertical rails to soften loading on the gripper block assemblies as the assemblies enter the vertical run. The section modulus is designed at a given gripper block assembly loading to allow the vertical rails to flex at the outermost extents thereof, thereby giving the gripper block assemblies more time to accept their full loading.

In the method for injecting coil tubing of the invention, the main injector frame is positioned adjacent the well bore with the central vertical axis of the frame aligned with the well vertical axis. A continuous length of coil tubing is then fed along the central vertical axis and is gripped by,the gripper block assemblies to inject the tubing into the well bore. The tubing can be retrieved by reversing the direction of the chain drive.

Additional objects, features and advantages will be apparent in the written description which follows.

DETAILED DESCRIPTION OF THE INVENTION

Figure 1:
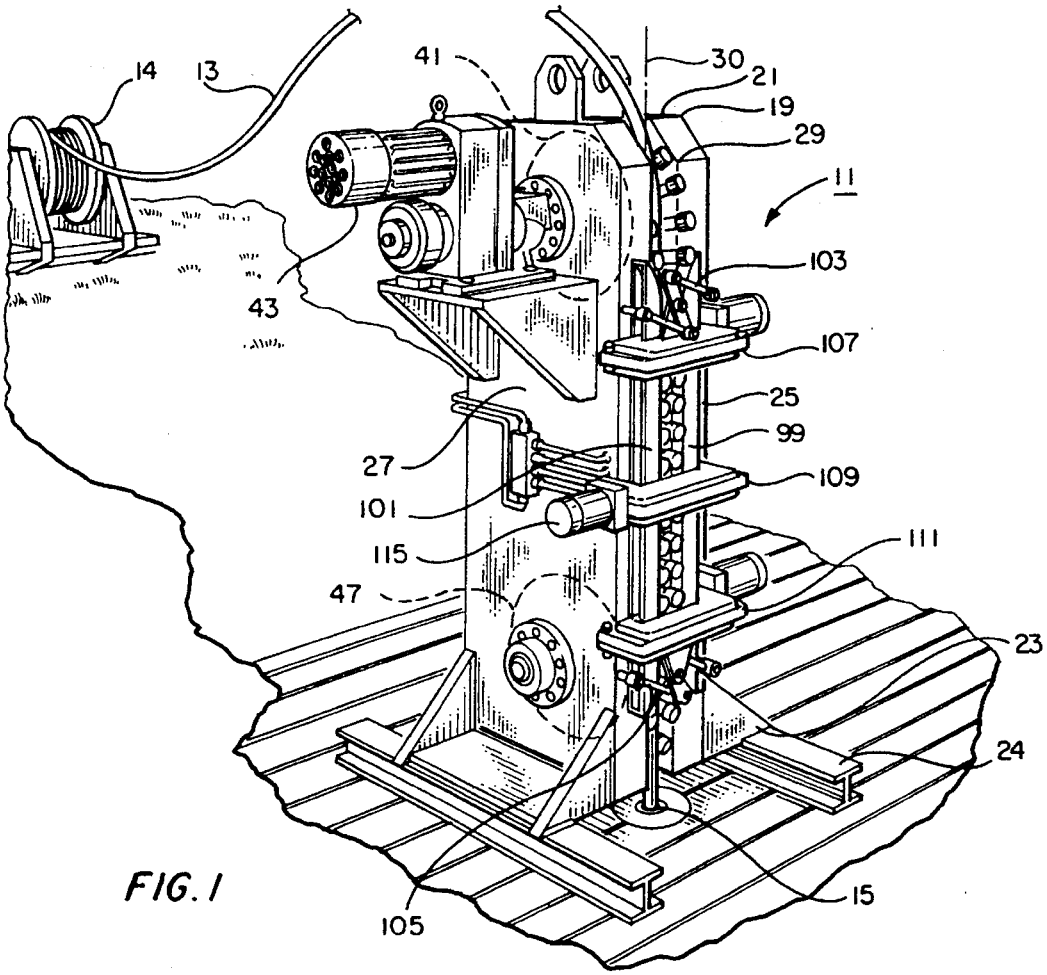
FIG. 1 is a perspective view of a coil tubing injector unit of the invention showing a length of coil tubing being fed from via collection reel into well bore.
Figure 9:
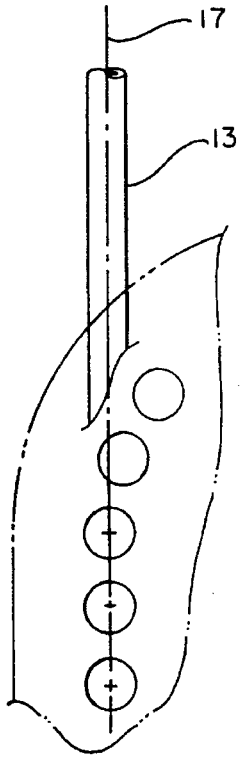
FIG. 9 is a schematic view of the chain drive and vertical run of the injector unit illustrating the alignment of the central vertical axis of the injector unit with the vertical axis of the well bore.

FIG. 1 shows a coil tubing injector unit of the invention designated generally as 11. The injector unit 11 is used for injecting a continuous length of coil tubing 13, as from a take-up reel 14, into a well bore 15 having a vertical well axis (17 in FIG. 9).

A main injector frame 19 is positionable adjacent the well bore 15 and has a top 21, a bottom or base 23 mounted on rails 24, and opposing vertical sides 25, 27. The opposing vertical i, sides 25, 27 have a longitudinal opening 29 formed therein which defines a vertical run for the injector unit 11. The vertical run defines a central vertical axis 30 for the injector unit 11 which is alignable with the well bore vertical axis (17 in FIG. 9).

Figure 2:
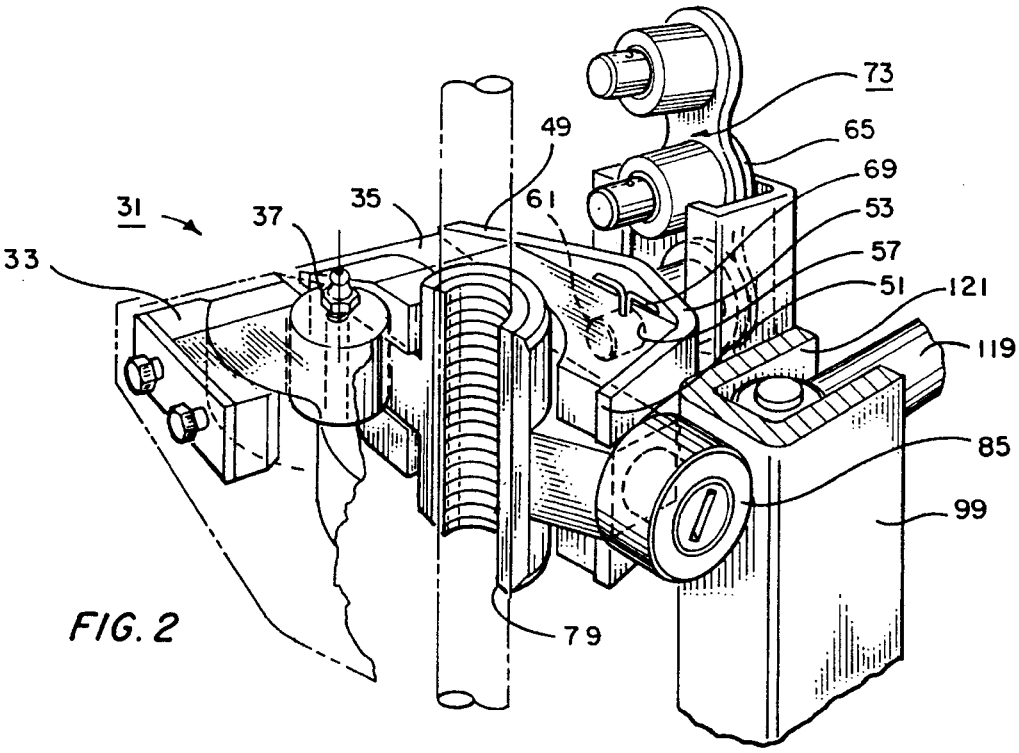
FIG. 2 is a partial, isolated view of a plier-like half of one of the gripper block assemblies used in the injector unit of FIG. 1.
Figure 4:
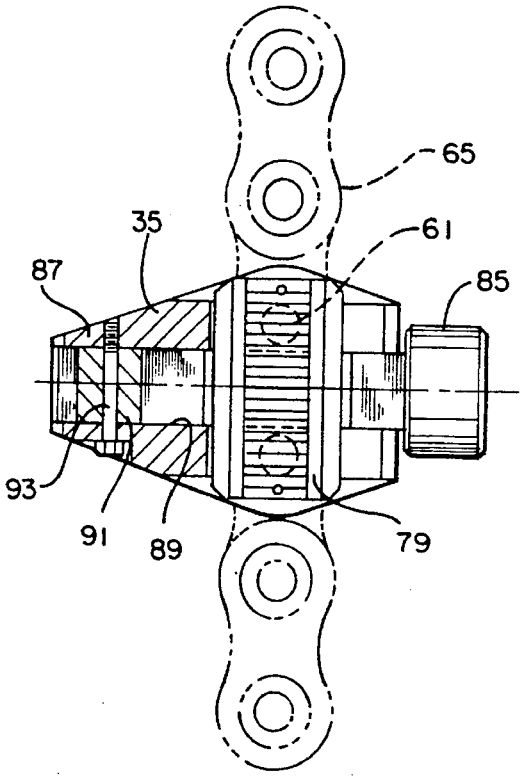
FIG. 4 is a view of one plier-like half of one of the gripper block assemblies of FIG. 3 showing its engagement with the chain drive of the injector unit.
Figure 3:
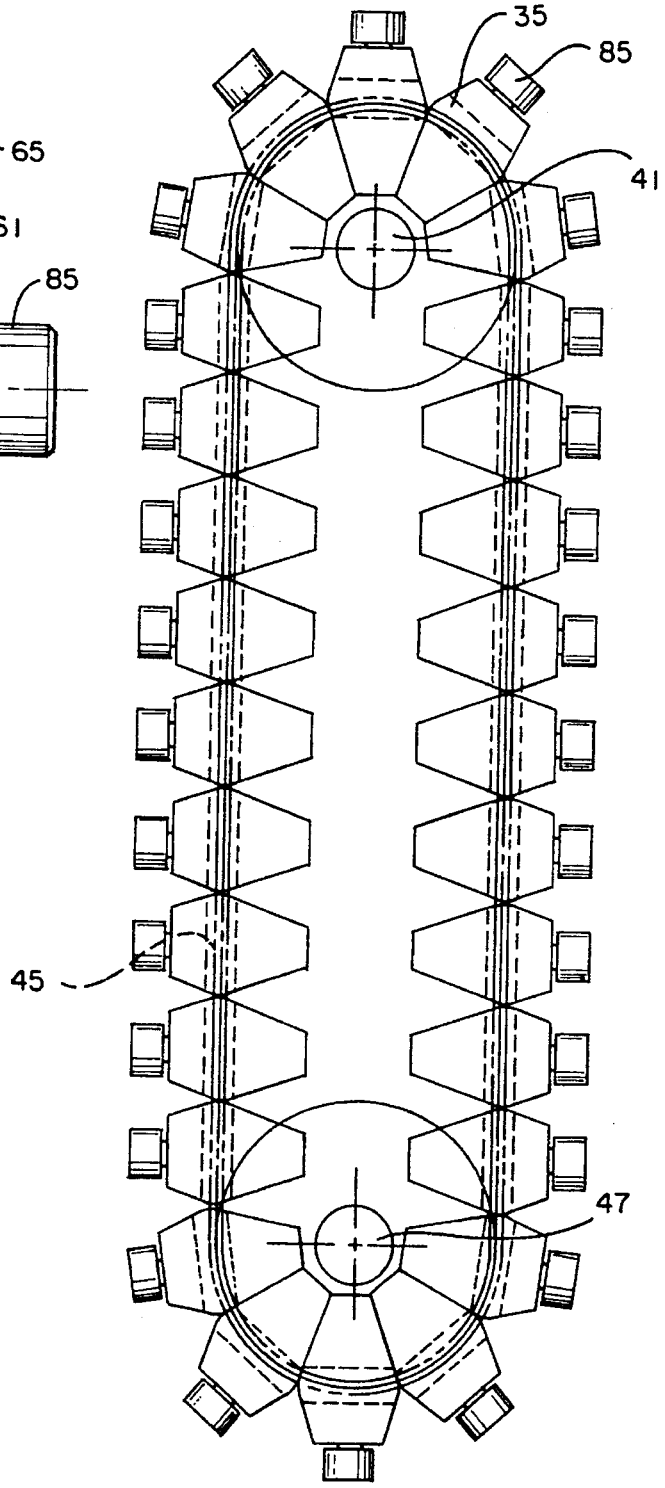
FIG. 3 is an isolated, side view of the chain drive which is used to drive the gripper block assemblies of the injector unit.

As shown in FIGS. 2–4, a plurality of gripper block assemblies 31 are carried on the main injector frame 19. Each of the gripper block assemblies 31 includes a pair of plier-like halves 33, 35 which are joined at the rear at a pivot point 37. As will be explained further with reference to FIGS. 5*a* and 5*b*, the plier-like halves 33, 35 are pivotable between an open position (FIG. 5*b*) and a closed, gripping position (FIG. 5*a* as the assemblies 31 enter the vertical run 29, whereby the plier halves 33, 35 grip a selected length of tubing (39 in FIG. 5*a*) fed into the main injector frame 19 along the central vertical axis 30 of the injector unit 11 in order to inject the tubing 13 into the well bore.

Drive means, located on the main injector frame 19, drive the gripper block assemblies 31 within the main injector frame. Preferably, the drive means is a chain drive which includes a drive sprocket (illustrated by dotted lines as 41 in FIG. 1) which is driven by a hydraulic motor 43 in conventional fashion. The drive sprocket 41 has an associated chain 45 (FIG. 3) and the gripper block assemblies 31 are carried on the chain as the chain moves in a continuous loop between the drive sprocket 41 and an idler sprocket 47 mounted within the main injector frame.

As shown in FIG. 2, each pair of plier-like halves 33, 35 of each gripper block assembly 31 is carried within a rigid bucket 9 having a front opening 51. At least one of the opposing sides 53, 55 and preferably both sides are provided with apertures 57, 59 for receiving the lug 61, 63 of an associated chain link 65, 67 of the drive chain. The lugs 61, 63 are retained within the apertures 57, 59 provided within the buckets by cotter pins 69.

Figure 5A:
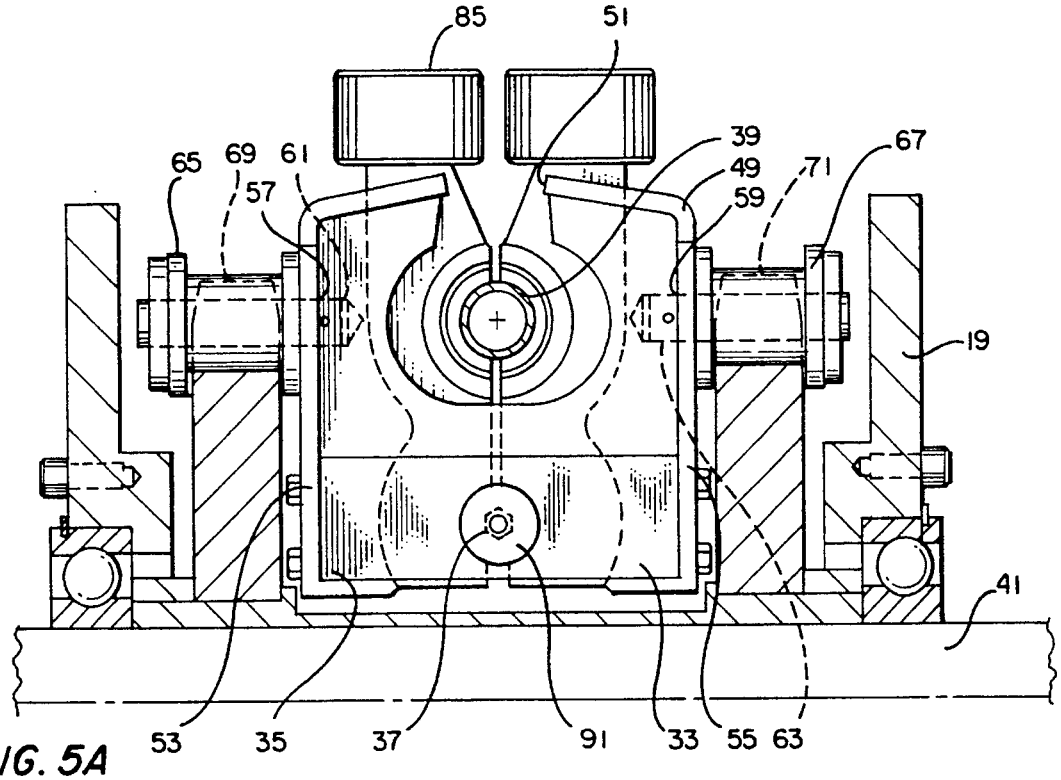
FIG. 5*a* is a top view of a gripper block assembly showing the assembly entering the vertical run of the injector unit with the gripper block assemblies in the closed, gripping position.

As best seen in FIG. 5*a*, the drive sprocket 41 includes teeth 69, 71 which engage selected openings 73 provided by the links 65 of the chain 45 for driving the chain 45 within the main injector frame 19. As best shown in FIG. 3, the chain drive carries twenty-eight buckets 49, each bucket having an associated pair of plier-like halves, as it travels in a continuous loop between the drive sprocket 41 and the idler sprocket 47 within the main injector frame.

Figure 5B:
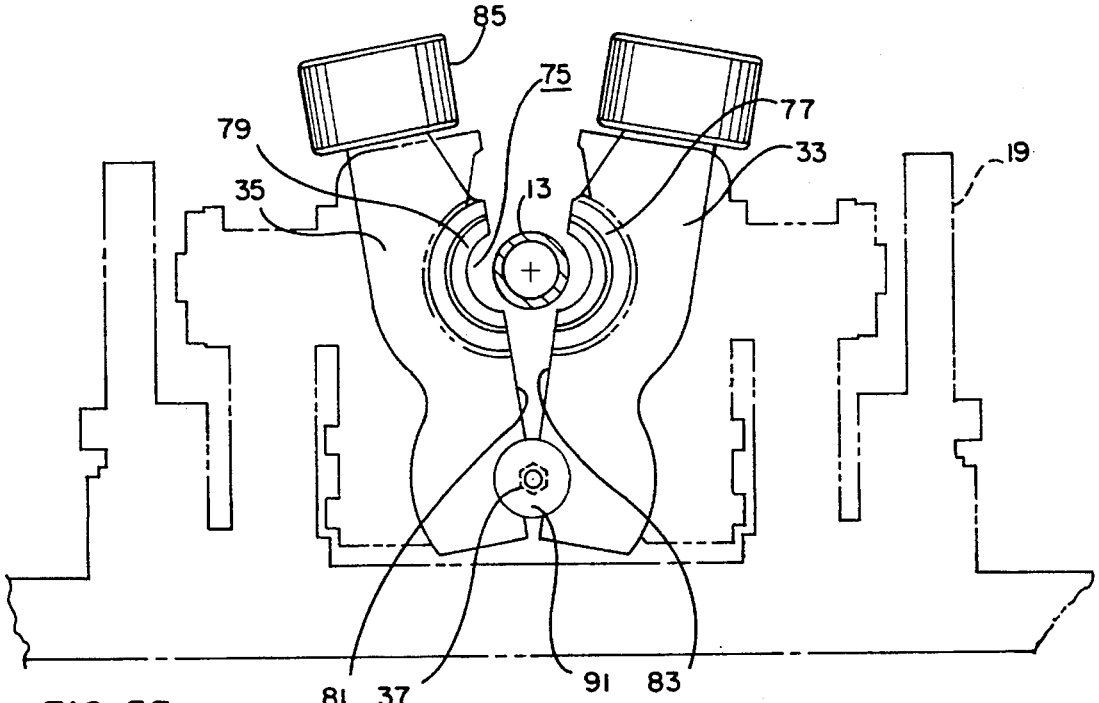
FIG. 5*b* is a view similar to 5*a* showing the gripper block assemblies in the open position prior to entering the vertical run of the injector unit.

As seen in FIGS. 5*a* and 5*b*, the gripper block halves 33, 35 together form a jaw opening 75 of predetermined size for gripping a selected length of coil tubing. Each of the plier halves 33, 35 preferably includes a replaceable insert 77, 79 which forms a semi-circular recess within the respective face 81, 83 of each plier-like half. The replaceable inserts are preferably formed of a softer material than the remainder of the gripper block assembly, for instance brass or aluminum. By changing the replaceable insert 77, 79, the size of the jaw opening 75 can be varied, whereby a variety of diameters of coil tubing can be injected into the well bore. Also, the replaceable inserts receive the greatest wear during use and can be replaced more economically than the entire gripper block assembly.

As shown in FIG. 4, each plier-like half 35 includes a front roller bearing 85 and a tapered rear surface 87. An internal channel 89 receives one side of a cylindrically shaped mounting member 91 which forms a rear pivot point for the plier-like halves 33, 35 and which includes a bolt 93 for securing the member 91 and the plier-like halves within the respective bucket 49.

Figure 6:
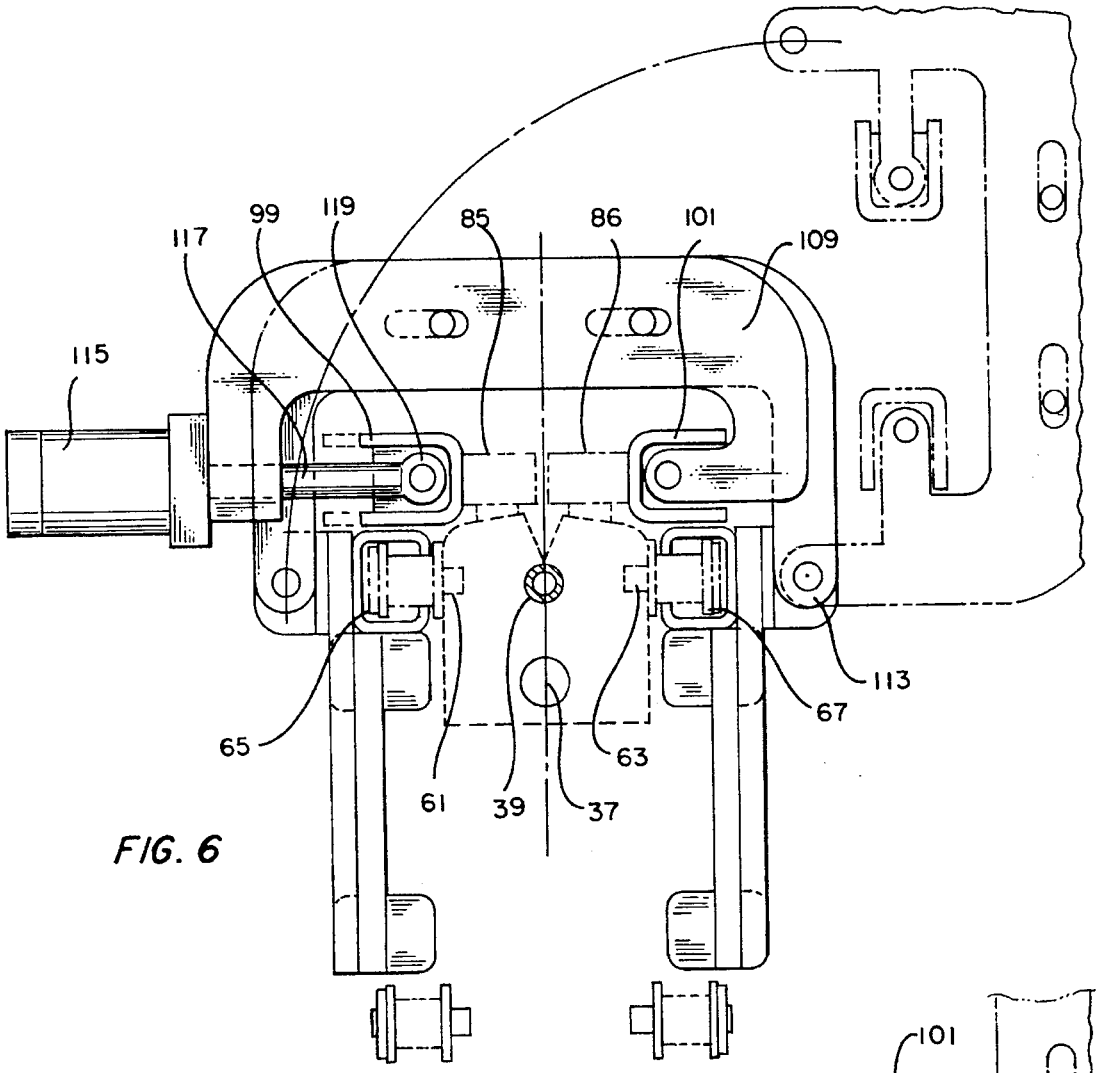
FIG. 6 is a top View of the injector unit showing the C-shaped clamps of the clamping assembly being pivoted between the disengaged and engaged position with respect to the coil tubing being fed within the vertical run of the injector unit.
Figure 7:
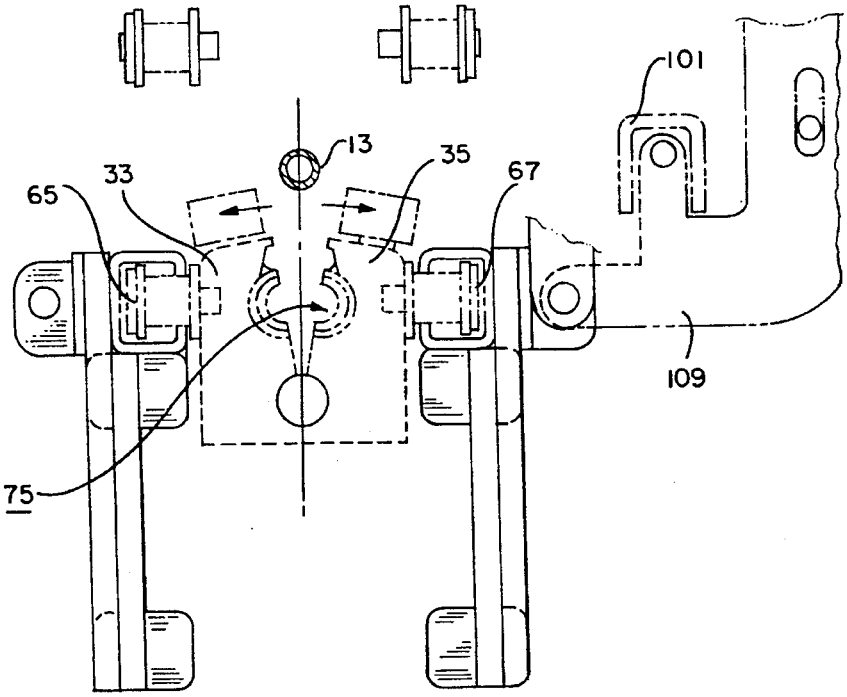
FIG. 7 is a view similar to FIG. 6 showing the C-shaped clamps being pivoted to the open position, thereby allowing the plier-like halves of the gripper block assemblies to move to the open position.

As shown in FIGS. 1 and 6–7, the injector unit 11 also includes a clamping assembly including first and second vertical rails 99, 101 which are spaced a selected distance within the clamping assembly for frictionally engaging the gripper block assemblies 31. The clamping assembly also includes', a plurality of C-shaped clamps 107, 109, 111, each of which is pivotally mounted at one extent 113 (FIG. 6) whereby the C-shaped clamps are pivotable between the disengaged and engaged positions. By moving the C-shaped clamps to the engaged position, the vertical rails 99, 101 are caused to contact the roller bearings 85, 86 of the gripper block assemblies to pivot the gripper blocks to the closed, gripping position illustrated in FIG. 6. Preferably, the vertical rails 99, 101 are connected to scissor mechanisms 103, 105 at the upper and lower extents thereof for varying the space between the vertical rails.

As illustrated in FIGS. 6 and 7, the C-clamps 107, 109, 111 can be pivoted to the disengaged position shown in FIG. 7, whereby the jaw opening 75 of the gripper block assemblies can be widened to allow the main injector frame 19 to be moved in a transverse direction with respect to the well bore vertical axis 17, as by sliding the unit in a direction transverse to the well vertical axis. In this way, a selected length of coil tubing 13 being fed within the well bore 15 is allowed to pass through the longitudinal opening 29 which defines the vertical run of thee coil tubing unit. This allows the injector unit 11 to be removed from the string of coil tubing, should problems occur during a well workover operation. It is not necessary to separate the continuous length of tubing, as was necessary in the past with opposing chain drive systems.

The clamping assembly also includes adjustment means, such as hydraulic cylinders 115 (FIG. 6) each of which includes an output shaft 117 having an outer extent 119 which is received within the U-shaped opening (121 in FIG. 2) of a respective vertical rail 99. In this way, a selected one of the cylinder and output shaft are operatively engaged with at least one of the vertical rails 99 of the clamping assembly for varying the distance between the rails. Thus, as the output shaft (117 in FIG. 6) moves to the extended position, the scissor mechanisms 103, 105 move the vertical rails closer together. As the output shaft 117 is moved to the retracted position, the scissor mechanisms allow the vertical rails to separate to a greater distance. By varying the distance between the vertical rails 99, 101, it is possible to vary the degree of frictional engagement of the gripper block assemblies 31 on the length of coil tubing 13 being injected into the well bore 15.

Figure 8:
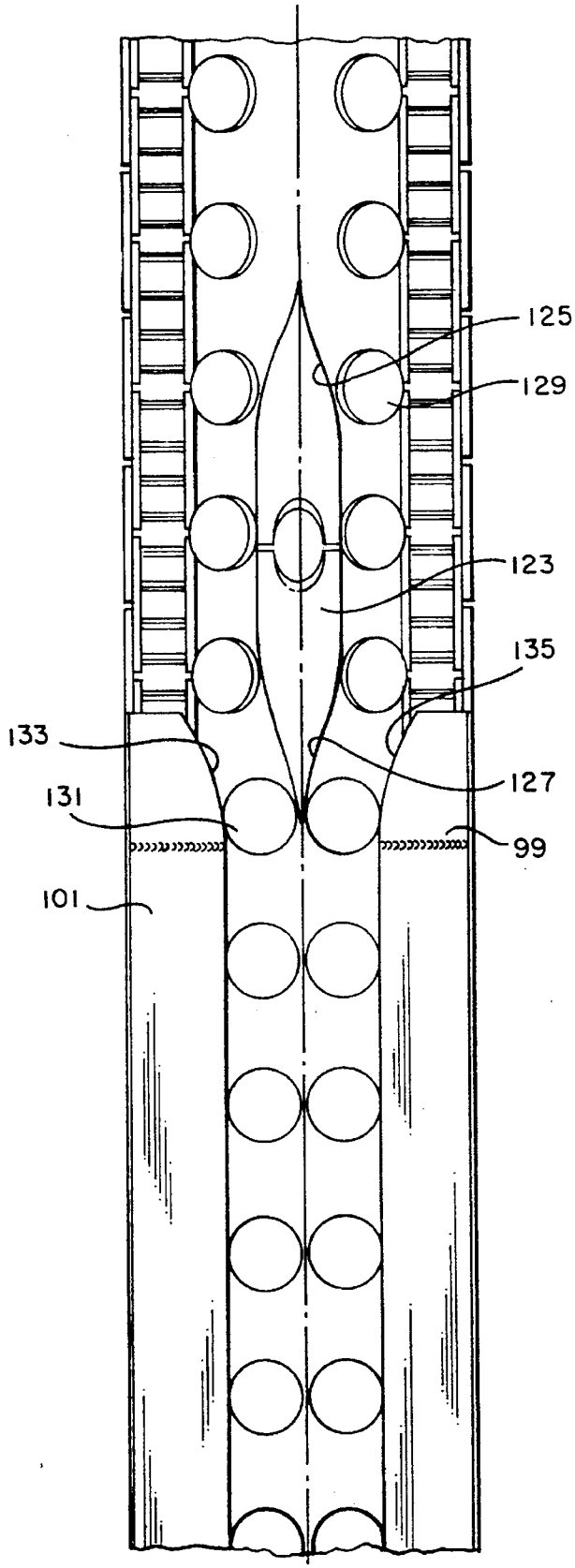
FIG. 8 is a top, plan view of the prior art injector unit showing a portion of the drive chain and gripper block assemblies and also showing the spreader plate which pivots the plier-like halves of the gripper block assemblies to the open position prior to entering the vertical run.

As shown in FIG. 8, the main injector frame 19 preferably includes a fixed spreader plate 123 having tapered upper and lower extents 125, 127, respectively. The spreader plate 123 is located within the longitudinal opening 29 of the main frame 13 in alignment with the vertical run for pivoting the plier-like halves of the gripper block assemblies 31 to the open position illustrated at 129 in FIG. 8 prior to entering the clamping assembly. A the gripper block assemblies 31 enter the vertical rails 99, 101, the plier-like halves 33, 35 move to the closed position, illustrated at 131 in FIG. 8.

In the method for injecting coil tubing using the device of the invention, the main injector frame 19 is positioned adjacent the well bore 15 with the central vertical axis 30 thereof aligned with the well bore vertical axis 17 and a continuous length of tubing is fed along the central vertical axis. The hydraulic motor 43 is then actuated to turn the drive sprocket 41 and the chain drive, thereby causing the gripper block assemblies 31 to travel in a continuous loop within the main frame between the drive sprocket 41 and the idler sprocket 47. As the gripper block assemblies enter the vertical run and contact the upper tapered surfaces 133, 135 (FIG. 8) of the vertical rails, the plier-like halves 33, 35 are moved to the closed position, causing the replaceable inserts 77, 79 to frictionally engage the tubing 13 at a selected location. In this way, a selected length of tubing 13 is fed into the main injector frame 19 along the central vertical axis 30 and is injected into the well bore.

The hydraulic cylinders 115 on the clamping mechanism can be selectively actuated in order to vary the distance between the vertical rails 99, 101 and thereby vary the compressive force exerted by the gripper block assemblies on the length of tubing. Using the device of the invention, 1 to 2 inch diameter tubing can be fed into the well bore at a rate on the order of 250–300 feet per minute.

If a problem occurs during well workover operations, the device of the invention can be easily removed from the coil tubing string. The C-shaped clamps 107, 109 are first pivoted about their pivot points 113 to the open position shown in FIG. 7 and the plier-like halves of the gripper block assembly are spread to the open position. The injector unit can then be removed from the coil tubing by sliding the unit in a direction transverse to the vertical well axis.

Figure 10:
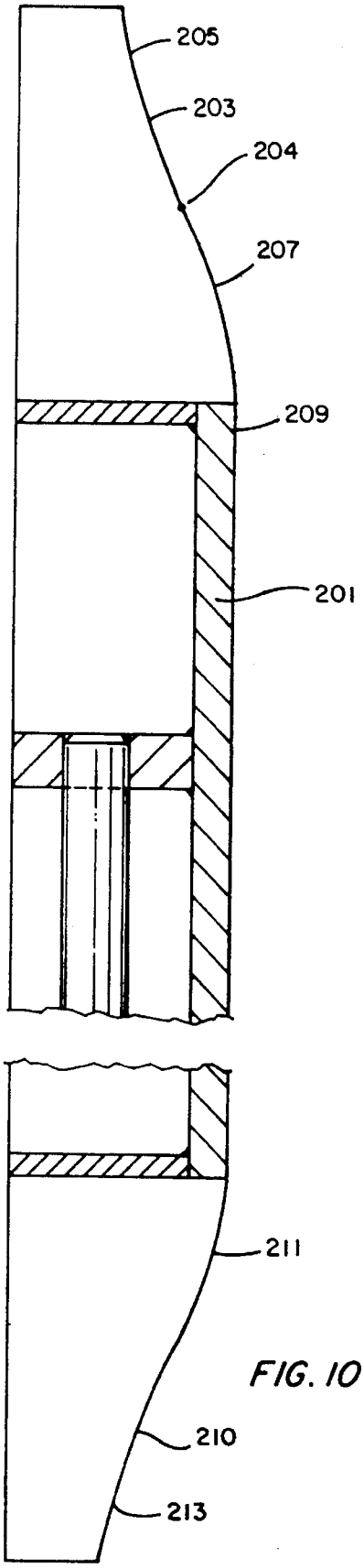
FIG. 10 is a partial, sectional view of the improved vertical run of the main injector frame of the injector unit of the invention showing the linear accelerator ramps thereof.

FIG. 10 is a partial, cross-sectional view of an improved feature of the coil tubing injector unit of the invention. As shown in FIG. 10, the vertical rail 201 has an upper tapered Surface 203 which is shaped as a linear accelerator ramp in order to minimize loading on the gripper block assemblies as they enter the vertical run and reduce noise during operation of the injector unit. Preferably each upper tapered surface has an outermost extent 205 which is concave in profile. The outermost extent 205 of each upper tapered surface joins an innermost extent 207 which assumes a convex profile. The innermost extent of each upper tapered surface joins a vertical planar surface 209 which extends downwardly in the direction of the well bore vertical axis 30. As each gripper block roller,bearing 85 travels over the outermost extent 205 of upper tapered surface 203 it is smoothly accelerated until it reaches an approximate midpoint 204 which forms the transition to innermost extent 207. The roller bearing is then smoothly decelerated as it travels over innermost extent 207 until the gripper block assembly has contacted the tubing in the vertical run. The Objective of the improved design of the invention is to give linear acceleration and deceleration in the closing cycle.

Each opposing vertical rail also has a lower tapered surface 210 which is shaped as an oppositely arranged linear accelerator ramp in order to allow the gripper block assemblies to move smoothly apart as they leave the vertical run. Preferably, each lower tapered surface has an innermost extent 211 which is convex in profile, the innermost extent 211 being joined to an outermost extent which assumes a concave profile.

Figure 11:
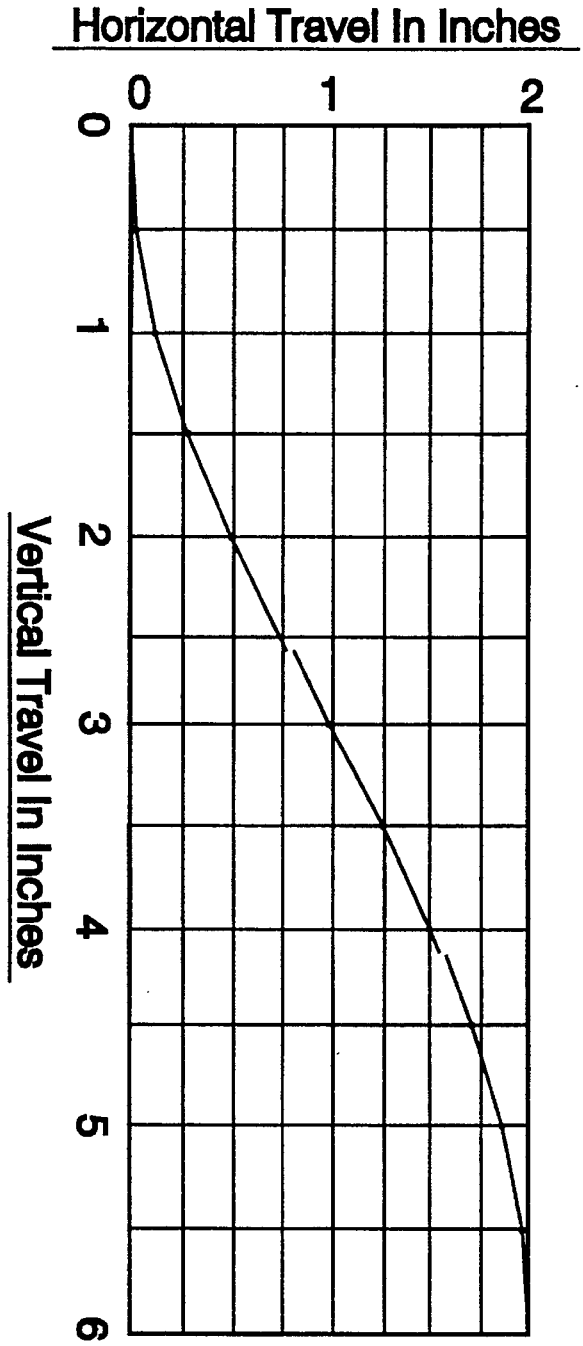
FIG. 11 is a graph of vertical travel in inches versus horizontal travel in inches for the gripper block assemblies entering the vertical run of the main injector frame, the graph being Used to determine the slope of the linear accelerator ramp.
Figure 12:
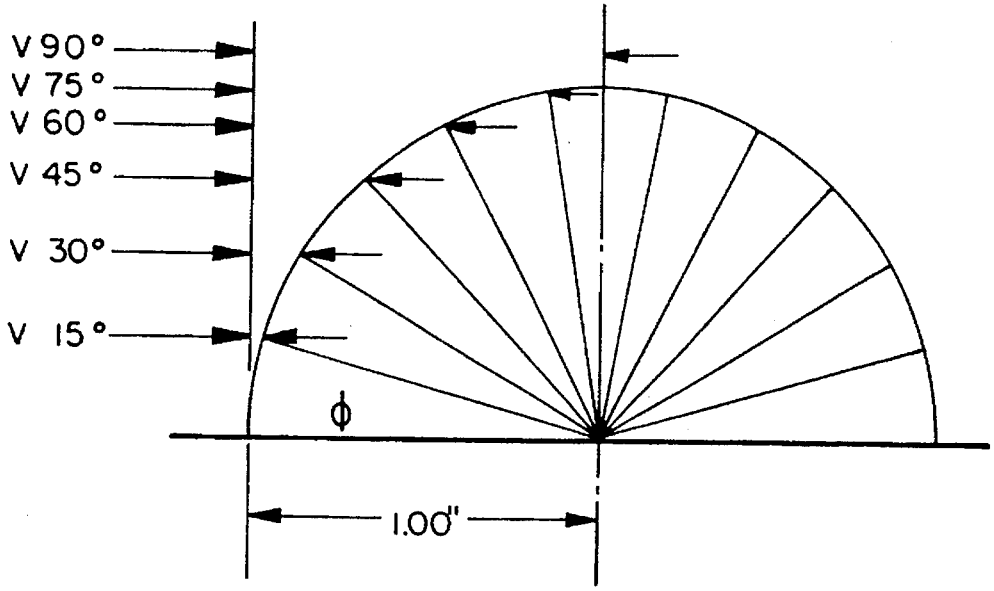
FIG. 12 is a graphical representation of the horizontal displacement of the gripper block assemblies used in calculating the slope of the linear accelerator ramp.
Figure 13:
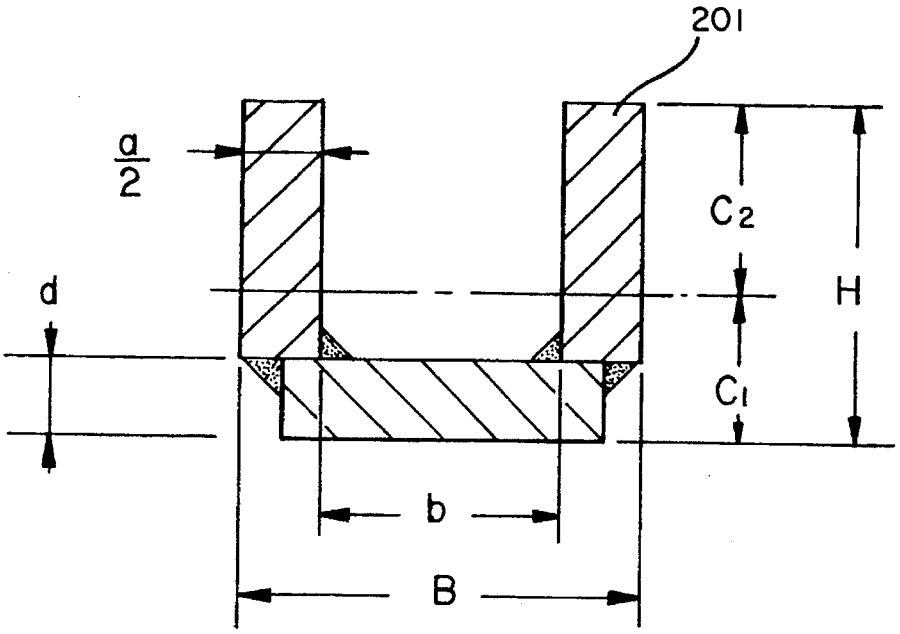
FIG. 13 is an isolated, cross-sectional view of one side of the vertical run of the injector unit of the invention illustrating the stress calculations used to determine the section modulus and soften the gripper block loadings as they enter the vertical run.

The following examples are intended to be illustrative of the invention:

The slope of the upper and lower tapered surfaces 203, 210 in this example is determined with reference to FIGS. 11 and 12. In the case of the linear accelerator ramp 203, assume the following:

a) the gripper block assembly roller bearings 85 must be displaced 2.0" horizontally during 6" of vertical travel down the vertical run;

b) the vertical velocity at 150 ft/min. of tubing injection speed is 30 in/sec;

c) the time interval for horizontal displacement is:

$$\sim \text{length of displacement ramp} = 6.0 \text{ in.}$$

$$\sim \text{time} = \frac{6.0 \text{ in}}{30.0 \text{ in/sec}} = 0.20 \text{ sec.}$$

d) the average horizontal velocity is thus:

$$= \frac{2.0 \text{ in}}{0.20 \text{ sec}} \approx 10 \text{ in/sec.}$$

e) the maximum horizontal velocity will occur at 1.00 in of horizontal displacement and can be calculated as follows with respect to FIG. 12, as follows:

$$V_{90°} = \left(\frac{180°}{.20 \text{ sec}}\right)\left(\frac{2.00 \text{ in}}{360°}\right)(\pi)$$

$$V_{90°} = 15.708 \text{ in/sec}$$

f) the displacement of the gripper block assembly roller bearings 85 to give linear acceleration and deceleration during a 2.00 in closing cycle.

each 15° of travel in FIG. 1 represents 0.50 in of vertical roller movement.

horizontal travel of roller=1.00 in — (1.00) (cosϕ).

Thus:

Disp. 15°=0.034 in.

Disp. 30°=0.134 in.

Disp. 45°=0.293 in.

Disp. 60°=0.500 in.

Disp. 75°=0.741 in.

Disp. 90°=1.000 in.

Disp. 105°=1.259 in.

Disp. 120°=1.500 in.

Disp. 135°=1.707 in.

Disp. 150°=1.866 in.

Disp. 165°=1.966 in.

Disp. 180°=2.000 in.

These exemplary calculations are presented graphically in FIG. 11. This shape minimizes the loading on the gripper block assemblies and reduces noise during operation. While the diameter of the roller bearings (85 in FIG. 2) used in the gripper block assemblies will affect the final slope of the acceleration ramps somewhat, FIG. 11 is a close approximation of the final shape utilized.

Another aspect of the present invention is in the material design of the vertical rails which make up the vertical run of the injector unit. In the improved embodiment of the invention illustrated in FIGS. 10–13, each vertical rail 201 is designed to have a "section modulus" which is designed for a predetermined working stress as the gripper block assemblies enter the vertical run and contact the vertical rails. The predetermined working stress has been calculated to allow a selected deflection of the vertical rails to thereby soften the loading on the gripper block assemblies as the assemblies enter the vertical run.

If you assume a 1.0 in long machined section is needed to bring the roller bearings from no load to full load and that this must occur in 0.033 sec, this results in great shock loads being imposed on the roller bearings. Competitive designs utilize a large solid loading skate to force the gripper block assemblies against the coiled tubing. The present design intentionally allows the vertical rails to flex at their tips, thus giving the gripper assembly roller bearings more time to come up to load.

In order to explain the concept more fully, a typical numerical example will be given, it being understood that the specific parameters given would change with choice of materials, shape of the vertical rails, etc.:

First, assume the skates are subjected to bending stress as the roller enters the gripper path;

the greater the unit stress, the greater the elastic deformation;

the basics equation for stress in a loaded beam is as follows:

$$S = \frac{M}{Z}$$

$S =$ unit stress (psi)

$M =$ bending moment (in. lb)

$Z =$ section modulus of the given shape ($in^3$)

by designing the vertical rail outer extents to generate unit stress in the range from about 30 to 50% of material yield, a flexing or cushioning effect can be obtained.

The calculation of section modulus for the vertical rail in this example is as follows:

$$Z = \frac{(Bc_1^3 - bh^3 + ac_2^3)}{3(C_2)}$$

$$C_1 = \frac{(a)(w^2) + (b)(d^2)}{2[(a)(w) + (b)(d)]}$$

$$C_2 = W - C_1$$

If AISI NO. 8620 steel alloy is used with a minimum yield strength of 77000 psi, the section modulus can be designed to give a working stress of 38,500 psi when the gripper assembly roller bearings enter the load path. This high stress will result in rail deflection. This will result in a "cushioned" loading of the roller bearings.

Thus, the "section modulus" is designed, at a given gripper block assembly loading, to allow the vertical rails 201 to flex at the outermost extents (203 in FIG. 10) thereof, thereby giving the gripper block assemblies more time to accept their full loading. In the example given, for purposes of illustration, the section modulus is designed to generate unit stress of approximately 50% of material yield for the material selected for the vertical rails 201.

An invention has been provided with several advantages. The coil tubing injector unit of the invention is simpler in design and more economical to manufacture than were the prior art designs. Because opposing drive chains are not utilized, the present device requires only about forty percent of the moving parts of the prior art devices. Because the coil tubing injector unit features% an open-faced design, it allows the unit to be removed from a continuous length of tubing if problems occur during operations. The device is capable of handling larger tubing diameters, on the order of two inches or more. The replaceable inserts utilized in the gripper block assemblies allow the device to be easily refitted in the field to accommodate different diameter tubing being injected. The replaceable inserts are also more economical to replace than were the prior art, single piece grippers used in the opposing drive systems.

The design of the upper tapered surfaces on the vertical rails of the vertical run, as well as the selection of the vertical rail section modulus, minimizes loading on the gripper block assemblies as they enter the vertical run, allows controlled deflection of the vertical rails to soften loading on the gripper block assemblies and reduces noise during operation of the injector unit.

While the invention has been shown in only one of its forms, it is not thus limited but is susceptible to various changes and modifications without departing from the spirit thereof.

What is claimed is:

1. A coil tubing injector unit for injecting tubing into a well bore having a vertical well axis, the coil tubing injector unit comprising:

a main injector frame positionable adjacent the well bore, the main injector frame having a top, a bottom and opposing vertical sides, a selected one of the opposing vertical sides having a longitudinal opening formed therein which defines a vertical run for the injector unit, the vertical run defining a central vertical axis for the injector unit which is alignable with the well bore vertical axis;

a plurality of gripper block assemblies carried on the main injector frame, each of the gripper block assemblies including a pair of plier-like halves which are pivotable between an open position and a closed, gripping position as the assemblies enter the vertical run, whereby the plier halves grip a selected length of tubing fed into the main injector frame along the central vertical axis of the injector unit in order to inject the tubing into the well bore;

drive means located on the main injector frame for driving the gripper block assemblies within the main injector frame; and wherein the vertical run is defined by opposing vertical rails which are spaced apart a selected distance for frictionally engaging the gripper block assemblies as the assemblies enter the vertical run, each opposing vertical rail having an upper tapered surface which is shaped as a linear accelerator ramp in order to minimize loading on the gripper block assemblies as they enter the vertical run and reduce noise during operation of the injector unit, the upper tapered surface which is shaped as a linear accelerator ramp being defined by an outermost extent which is concave in profile, the outermost extent of each tapered surface joining an innermost extent which assumes a convex profile, the innermost extent joining a vertical planar surface which extends downwardly in the direction of the well bore vertical axis.

2. The coil tubing injector of claim 1, wherein each opposing vertical rail also has a lower tapered surface which is shaped as an oppositely arranged linear accelerator ramp in order to allow the gripper block assemblies to move smoothly apart as they leave the vertical run.

3. The coil tubing injector of claim 2, wherein each lower tapered surface has an innermost extent which is convex in profile and wherein the innermost extent joins an outermost extent which assumes a concave profile.

4. The coil tubing injector unit of claim 1, wherein the drive means is a chain drive including a drive sprocket and an associated chain, the gripper block assemblies being carried on the chain as the chain moves in a continuous loop about the drive sprocket.

5. The coil tubing injector of claim 1, wherein the vertical run defines an: open face for the coil tubing injector unit, the open face allowing a selected length of vertically oriented coil tubing being fed along the well vertical axis to pass through the vertical run by moving the main injector frame in a direction transverse to the well vertical axis when the gripper block assemblies are in the open position.

6. The coil tubing unit of claim 5, wherein the plier-like halves of the gripper block assemblies together form a jaw opening of predetermined size for gripping a selected length of coil tubing, each of the plier-like halves including a replaceable insert for varying the size of the jaw opening, whereby a variety of sizes of coil tubing can be injected into the well bore by interchanging the replaceable inserts.

7. A coil tubing injector unit for injecting tubing into a well bore having a vertical well axis, the coil tubing injector unit comprising:

a main injector frame positionable adjacent the well bore, the main injector frame having a top, a bottom and opposing vertical sides, a selected one of the opposing vertical sides having a longitudinal opening formed therein which defines a vertical run for the injector unit, the vertical run defining a central vertical axis for the injector unit which is alignable with the well bore vertical axis;

a chain drive located on the main injector frame having a drive sprocket at a first vertical elevation on the main injector frame and having a cooperating sprocket located at a second, lower vertical elevation on the main injector frame, the chain drive having an associated chain which is driven in a continuous loop between the drive and cooperating sprockets;

a plurality of gripper block assemblies carried by the chain drive, each of the gripper block assemblies including a pair of plier-like halves which are pivotable between an open position and a closed, gripping position as the chain drive enters the vertical run, whereby the plier halves grip a selected length of tubing fed into the main injector frame along the central vertical axis of the injector unit in;order to inject the tubing into the well bore;

wherein the vertical run is defined by opposing vertical rails which are spaced apart a selected distance for frictionally engaging the gripper block assemblies as the assemblies enter the vertical run, each opposing vertical rail having an upper tapered surface which is shaped as a linear accelerator ramp in order to minimize loading on the gripper block assemblies as they enter the vertical run and reduce noise during operation of the injector unit, the upper tapered surface which is shaped as a linear accelerator ramp being defined by an outermost extent which is concave in profile, the outermost extent of each tapered surface joining an innermost extent which assumes a convex profile, the innermost extent joining a vertical planar surface which extends downwardly in the direction of the well bore vertical axis; and wherein each opposing vertical rail has a section modulus and wherein each section modulus is designed for a predetermined working stress as the gripper block assemblies enter the vertical run and contact the vertical rails, the predetermined working stress being selected to allow a selected deflection of the vertical rails to soften loading on the gripper block assemblies as the assemblies enter the vertical run.

8. The coil tubing injector unit of claim 7, wherein the section modulus is designed to generate unit stress in the range from about 30 to 50% of material yield for the material selected for the vertical rails.

9. The coil tubing injector of claim 8, further comprising a spreader plate located on the main injector frame in alignment with the vertical run for pivoting the plier-like halves of the gripper block assemblies to the open position prior to entering the vertical run.

10. A method for injecting coil tubing into a well bore having a vertical well axis, the method comprising the steps of:

positioning a main injector frame adjacent the well bore, the main injector frame being provided with a top, a bottom and opposing vertical sides, a selected one of the opposing vertical sides being provided with a longitudinal opening formed therein which defines a vertical run for the injector unit, the vertical run defining a central vertical axis for the injector unit which is alignable with the well bore vertical axis;

providing a plurality of gripper block assemblies which are carried on the main injector frame, each of the gripper block assemblies including a pair of plier-like halves which are pivotable between an open position and a closed, gripping position as the assemblies enter the vertical run, whereby the plier halves grip a selected length of tubing fed into the main injector frame along the central vertical axis of the injector unit in order to inject the tubing into the well bore;

feeding a continuous length of coil tubing from a take-up reel along the central vertical axis of the injector unit;

driving the gripper block assemblies within the main injector frame to inject the coil tubing within the well bore; and wherein the vertical run is defined by opposing vertical rails which are spaced apart a selected distance for frictionally engaging the gripper block assemblies as the assemblies enter the vertical run, each opposing vertical rail having an upper tapered surface which is shaped as a linear accelerator ramp in order to minimize loading on the gripper block assemblies as they enter the vertical run and reduce noise during operation of the injector unit, the upper tapered surface which is shaped as a linear accelerator ramp being defined by an outermost extent which is concave in profile, the outermost extent of each tapered surface joining an innermost extent which assumes a convex profile, the innermost extent joining a vertical planar surface which extends downwardly in the direction of the well bore vertical axis.

11. The method of claim 10, wherein each opposing vertical rail has a section modulus and wherein each section modulus is designed for a predetermined working stress as the gripper block assemblies enter the vertical run and contact the vertical rails, the predetermined working stress being selected to allow a selected deflection of the vertical rails to soften loading on the gripper block assemblies as the assemblies enter the vertical run.

* * * * *